US008272133B2

(12) United States Patent
Wascow

(10) Patent No.: US 8,272,133 B2
(45) Date of Patent: Sep. 25, 2012

(54) CIRCULAR SAW HAVING BEVEL AND DEPTH OF CUT DETENT SYSTEM

(75) Inventor: Joseph Wascow, Hawthorn Woods, IL (US)

(73) Assignee: Robert Bosch GmbH, Stuttgart (DE)

( * ) Notice: Subject to any disclaimer, the term of this patent is extended or adjusted under 35 U.S.C. 154(b) by 1152 days.

(21) Appl. No.: 10/613,717

(22) Filed: Jul. 3, 2003

(65) Prior Publication Data

US 2005/0000338 A1 Jan. 6, 2005

(51) Int. Cl.
*B27B 9/02* (2006.01)

(52) U.S. Cl. ..... 30/376; 30/377

(58) Field of Classification Search ..... 30/374–377, 30/388, 390, 391; D8/66, 69, 61
See application file for complete search history.

(56) References Cited

U.S. PATENT DOCUMENTS

| | | | | |
|---|---|---|---|---|
| 1,830,580 | A * | 11/1931 | Wappat | 30/376 |
| 2,987,084 | A | 6/1961 | Mandell | |
| 4,011,782 | A * | 3/1977 | Clark et al. | 83/471.3 |
| 4,589,208 | A | 5/1986 | Iwasaki et al. | 30/376 |
| 4,856,394 | A | 8/1989 | Clowers | 83/56 |
| 4,982,501 | A | 1/1991 | Sauerwein et al. | 30/376 |
| 4,999,916 | A | 3/1991 | Sistare | 30/376 |
| 5,425,294 | A | 6/1995 | Ushiwata et al. | 83/471.3 |
| 5,433,008 | A | 7/1995 | Barger, Jr. et al. | 30/376 |
| 5,452,515 | A | 9/1995 | Schilling | 30/376 |
| 5,570,511 | A | 11/1996 | Reich et al. | 30/376 |
| 6,055,734 | A * | 5/2000 | McCurry et al. | 30/391 |
| 6,202,311 | B1 | 3/2001 | Nickels, Jr. | 30/376 |
| 6,691,418 | B1 * | 2/2004 | Lewin et al. | 30/375 |

FOREIGN PATENT DOCUMENTS

| | | |
|---|---|---|
| DE | 88 03 627 | 5/1988 |
| JP | 59 167202 | 9/1984 |
| JP | 2003-145507 | 5/2003 |
| WO | WO 00/51772 | 8/2000 |

* cited by examiner

*Primary Examiner* — Stephen Choi
(74) *Attorney, Agent, or Firm* — Greer, Burns & Crain, Ltd.

(57) ABSTRACT

A circular saw having a saw blade depth adjustment detent mechanism for facilitating rapid positioning of a saw blade at predetermined depth positions includes a housing enclosing a motor disposed therein that rotates a circular saw blade. The circular saw includes a foot which rides on a workpiece to guide the saw blade during cutting operations. The saw blade depth adjustment detent mechanism pivotally interconnects the foot to said housing such that the circular saw blade is adjustable to the foot through a number of saw blade depth settings within a range of saw blade depth of cuts relative to the foot. The saw blade depth adjustment detent mechanism includes a saw blade depth detent and a second member having a plurality of spaced saw blade depth recesses that are each matingly engageable with the saw blade depth detent to provide the range of saw blade depths.

21 Claims, 8 Drawing Sheets

CIRCULAR SAW HAVING BEVEL AND DEPTH OF CUT DETENT SYSTEM

BACKGROUND OF THE INVENTION

The present invention generally relates to power hand tools, and more particularly to portable circular saws.

Portable circular saws are in widespread use for cutting workpieces such as lumber, vinyl siding, etc. Examples of such circular saws are those produced under the Skil brand by the Robert Bosch Tool Corporation of Chicago, Ill. These circular saws generally include a rotary blade assembly and a motorized drive unit disposed within a housing, a single handle disposed on the housing, and a base or foot that rides on the workpiece during cutting operations.

When using circular saws, it is frequently desired to make saw blade adjustments for controlling particular aspects of a cut. For example, U.S. Pat. No. 4,856,394 to Clowers discloses a circular saw with an assembly (see FIGS. 2 and 5) for adjusting a depth of cut by controlling the extent to which a saw blade moved by pivoting action of the housing is positioned below a base or shoe which supports the circular saw on a workpiece. The housing includes a locking means, which lockably engages a plate via a locking stud extending though the housing. The circular saw also includes a locking nut that is rotatable and lockable against the plate by means of a locking handle that fixes the housing relative to the shoe in a plurality of continuous positions.

It is also known to provide a portable circular saw with a bevel angle adjustment mechanism for adjusting a bevel angle of cut. One example of such a circular saw disclosed by U.S. Pat. No. 6,202,311 to Nickels, Jr. discloses a base and a saw blade arranged so that a bevel angle is adjustable relative to the base (see FIGS. 1 and 2). A mounting bracket is attached to the base for relative pivotable movement about an axis, which enables adjustment of the bevel angle of cut.

Another known circular saw having a bevel angle adjustment is disclosed in U.S. Pat. No. 5,452,515 to Schilling and includes a base plate, a saw blade arranged so that a bevel angle is adjustable relative to the base plate, and a clamping block. The clamping block is supported by the base plate and provided with a turning guide slot. In addition, the clamping block also has a plurality of arresting pockets arranged along the turning guide slot. A clamping screw extends through the turning guide slot and a supporting arm and carries at least one axially spring-biased displaceable arresting sleeve which can be positioned in one of the arresting pockets. Another known arrangement for adjusting a bevel angle includes a spring-loaded ball that can engage spherically-shaped recesses positioned on a mounting bracket.

A desirable saw blade depth mechanism and/or bevel angle adjustment mechanism provides for convenient, easy and speedy manipulation to set the desired saw blade depth and/or bevel angle. In some applications, an operator may need to frequently change the saw blade depth and/or bevel angle setting. If it is difficult to easily make an adjustment of the depth of cut or bevel angle, such difficulty can make a significant difference in operating efficiency. Two significant aspects of a saw blade depth mechanism and/or bevel angle adjustment mechanism are the ease of effecting adjusting movements of the mechanism, and the accuracy and ability of a user to consistently set desired saw blade depths and/or bevel angles.

Prior known arrangements for adjusting the depth of a saw blade and/or adjusting its bevel angle involved locating a saw blade relative to a base at different depths, or one or more predetermined bevel angles. However, such prior known arrangements are not without their drawbacks. For example, many known arrangements are awkward to use because the user must set a single lock while simultaneously maintaining the saw at a desired saw blade depth and/or bevel angle setting. This often results in discrepancies in depths of saw blade cuts and/or angles of cut, especially for common cutting angles, since the depth and/or angle of the saw blade are user dependent. Additionally, known bevel angle adjustment mechanisms, including those having a spring-loaded ball, often tend to become clogged due to wood sap, sawdust, and other debris accumulating on the adjustment mechanism. Accordingly, it is desirable to have a saw blade depth mechanism and a bevel angle adjustment mechanism that provide self-cleaning action, are easy to use, and provide accurate saw blade depth settings and bevel angle of cut settings.

SUMMARY OF THE INVENTION

The present invention is related to a circular saw that provides accurate multiple saw blade depth settings and/or bevel angle of cut settings through the use of an adjustable blade depth detent mechanism and a bevel angle adjustment detent mechanism. The invention eliminates the need for an operator to hold the saw blade in place for at the desired depth and/or bevel angle setting while locking the blade in position.

In a preferred embodiment, the adjustable saw blade depth detent mechanism includes a saw blade depth detent and a second member having multiple spaced saw blade depth recesses. The saw blade depth adjustable detent can be positioned in the multiple spaced saw blade depth recesses to provide selective saw blade depth settings that can range between zero and several inches, for example. The bevel angle adjustment detent mechanism can be manually overridden so that any incremental bevel angle settings can be set by an operator.

DETAILED DESCRIPTION OF THE PREFERRED EMBODIMENT

The present preferred embodiment provides improved saw blade depth detent and bevel angle adjustment detent mechanisms for a portable circular saw. Portable circular saws typically include a housing with a motor for driving a circular blade. A handle, which includes a switch for controlling power to the motor, typically is formed integrally with the housing, and enables an operator to control the circular saw during cutting operations. A base or foot is connected to the housing in a pivotable relationship that enables varied positioning of the saw blade relative to the foot.

Figure 1:
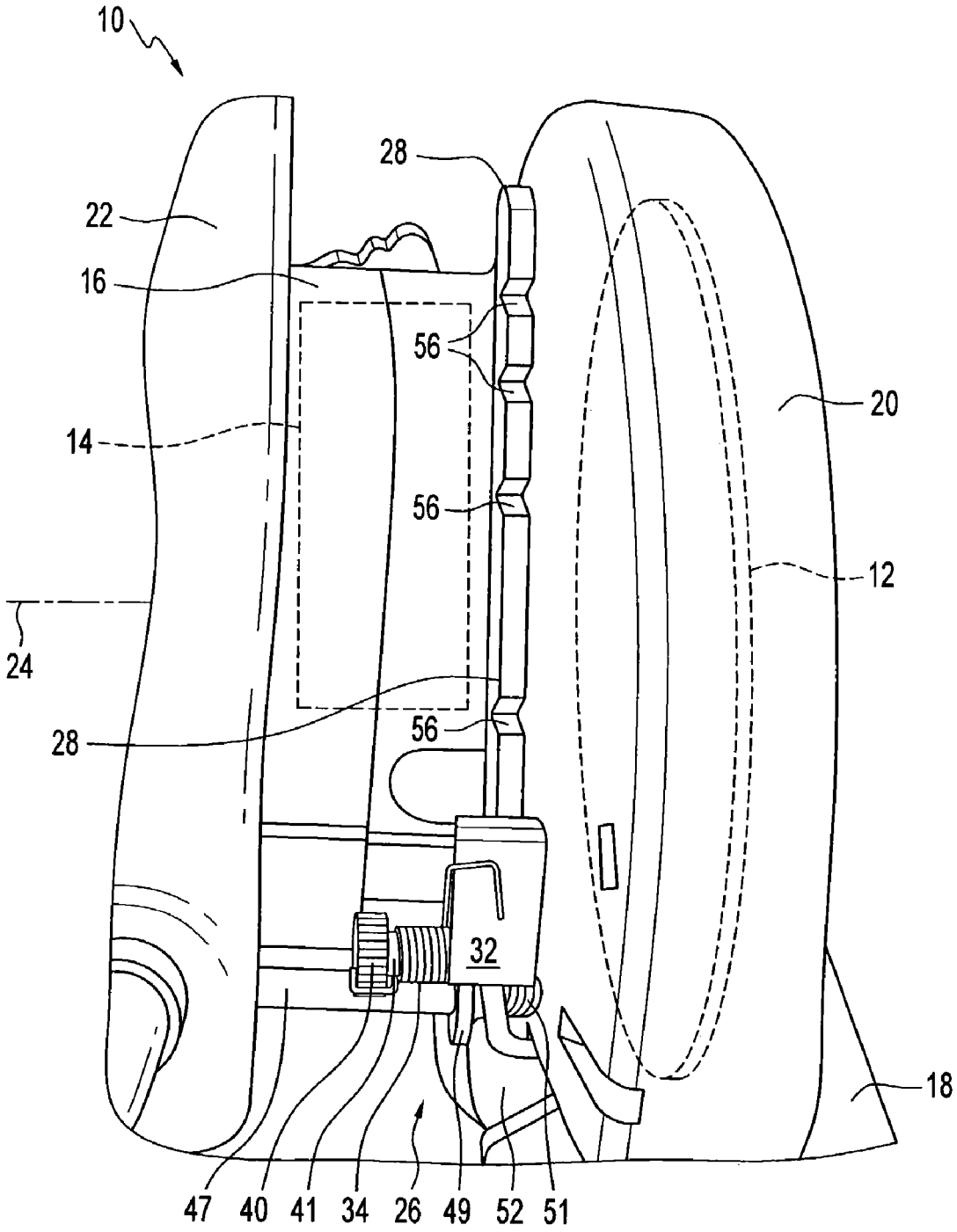
FIG. 1 is a perspective view of the rear of a portion of one embodiment of the present invention.

Turning now to the drawings, a circular saw embodying the present invention is illustrated in FIG. 1, and designated generally at reference numeral 10. The portable electric powered circular saw 10 includes a circular saw blade 12 and a motor 14 (both shown in phantom) encased in a housing 16, and a foot or base 18. Also included is a retractable arcuate lower saw blade guard (not shown) and a stationary arcuate upper saw blade guard 20 that shield an operator from the saw blade 12. For facilitating grasping of the circular saw 10, the housing 16 also forms a curved handle 22 that is integrally formed with and extends around a portion of the housing. The handle 22 includes a trigger switch (not shown) that may be actuated to supply power to the motor 14 and rotate the saw blade 12.

FIG. 1 illustrates the saw 10 positioned with a bevel angle of zero degrees, with the circular saw blade 12 mounted to the motor 14 in a conventional manner (not shown). While also not shown in detail, the output shaft of rotational axis 24 of the circular saw blade 12 is parallel to the foot 18. The upper blade guard 20 is preferably stationary and has: the lower blade guard pivotally mounted thereto. Generally, the lower blade guard is biased toward the closed position by a spring force and is mounted to the upper blade guard 20 so that the upper and lower blade guards rotate generally around the axis 24.

The portable circular saw 10 of the present invention includes a rectangular-shaped foot 18 (see FIG. 3) which is used to guide the circular saw during use. The foot 18 is a generally flat plate configured and arranged beneath the housing 16 to be pivoted relative to the saw blade 12 and the housing. A saw blade depth adjustment detent mechanism, generally designated at 26, engages a saw blade depth of cut bracket 28. The bracket 28 is connected to the foot 18 and positioned between the handle 22 and the upper blade guard 20. An advantage of the present saw blade depth adjustment detent mechanism 26 is that a user may selectively adjust the depth of cut of the circular saw 10 without having to forcibly manipulate a clamp or other mechanism to lock the saw blade 12 in position. Moreover, various saw blade depths may be selected for nominal lumber thickness values.

Figure 2:
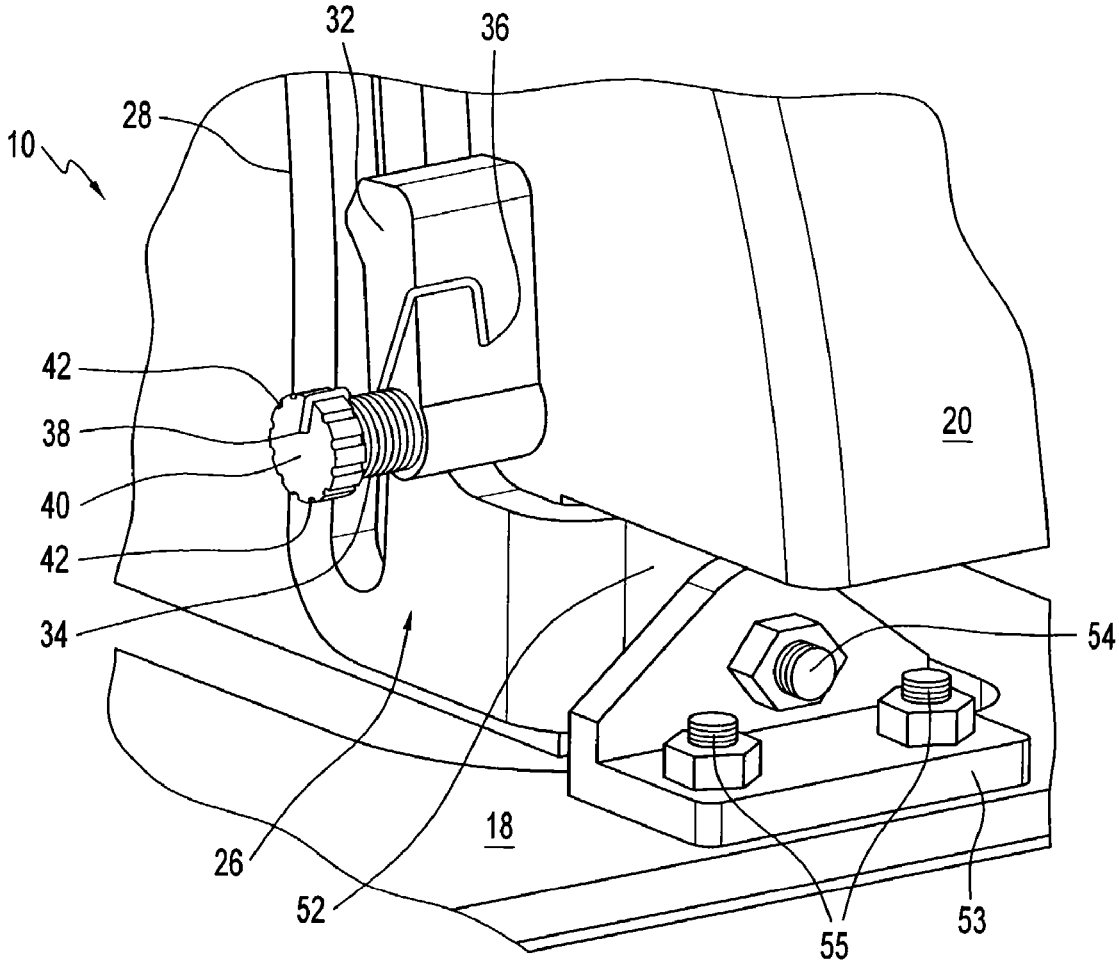
FIG. 2 is a perspective view of the embodiment illustrated in FIG. 1.

To initially set a particular depth of cut, the foot 18 can be adjusted so that a saw blade depth detent 32 can engage one of various notches in the bracket 28. As shown in FIGS. 1–4, the detent 32 is preferably pivotally biased against the bracket 28 by a spring 34 having one end portion 36 engaging the detent and an opposite end portion 38 attached to a bolt 40. It is contemplated in the illustrated embodiment that the bolt 40 can include multiple spring attachment grooves 42 for the end 38 to provide a range of spring tensions for biasing the detent 32 against the bracket 28 as best seen in FIG. 2. The bolt 40 is threaded into the upper guard 20 and has an axially extending shaft 41 that preferably has a smooth surface for facilitating pivoting action of the detent 32 about the shaft. The spring 34 preferably also rides on the shaft 41 of the bolt 40 and biases the detent 32 against the upper guard 20. While the detent 32 is preferably formed of a plastic material, such as DELRIN®, other materials may be substituted and are contemplated with the present invention.

The lever 30 includes a handle 44 that is secured to an end portion 46 of a shaft 47. The other end portion 48 of the shaft 47 passes though a washer 49 and a slot 50 (best seen in FIG. 4) of the bracket 28. The shaft 47 is threadingly engageable with a threaded stud 51 which is press fitted into or alternatively integrally formed with the upper guard 20. In this manner, rotation of the shaft 47 toward the foot 18 threads the shaft onto the threaded stud 51 and locks a lower portion 52 of the bracket 28 against the washer 49 thereby preventing rotation of the housing 16 relative to the foot 18. An L-shaped bracket 53 is connected by a bolt 54 to the lower portion 52 of the bracket 28 and is secured by bolts 55 to the foot 18. Alternatively, the L-shaped bracket 53 can be riveted to the bracket 28 and/or molded into the foot 18.

Figure 4:
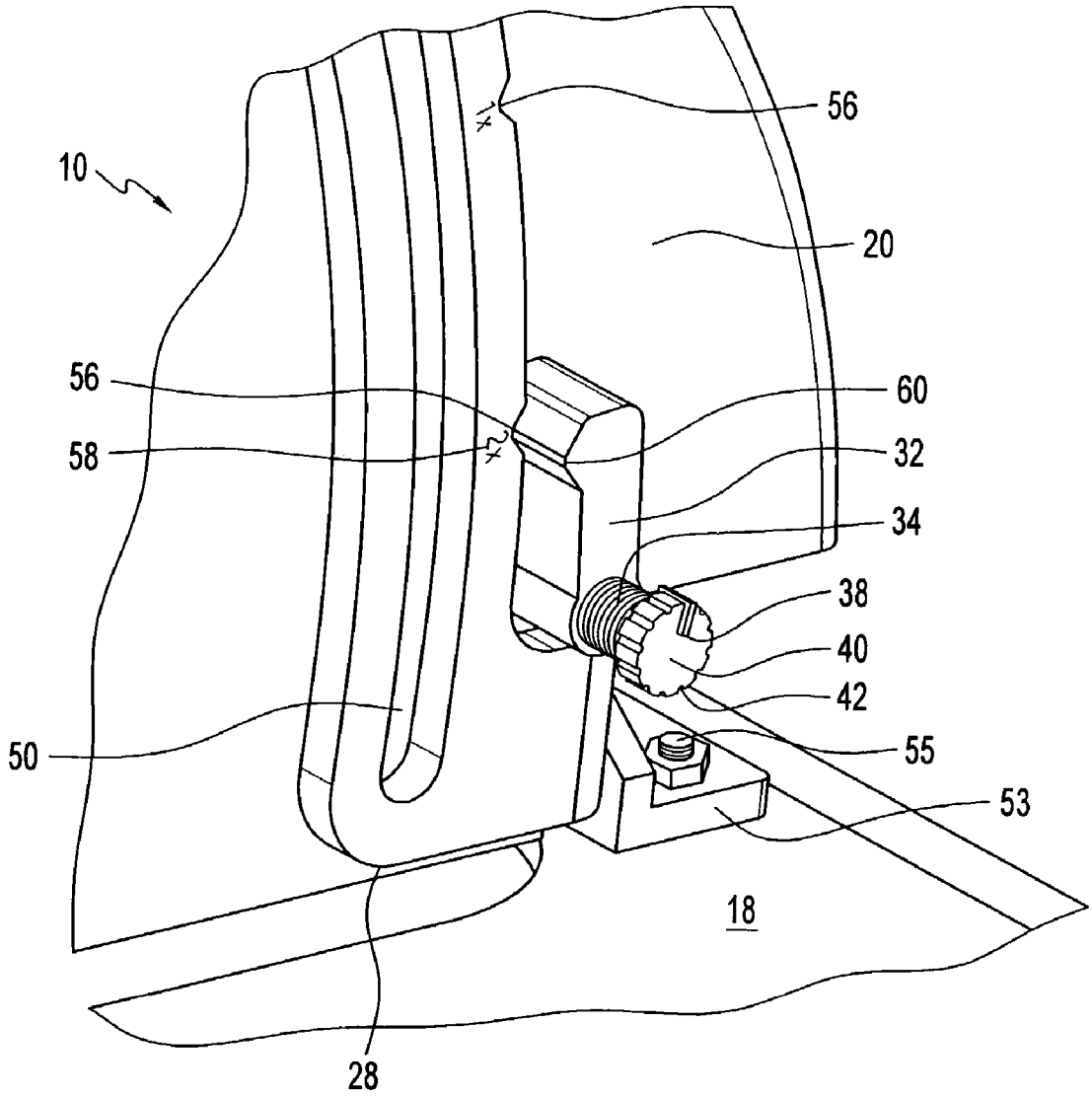
FIG. 4 is a partial side perspective view of the saw blade depth adjustment detent mechanism of the embodiment illustrated in FIG. 1.

FIG. 4 is a perspective side view of a portion of the saw blade depth adjustment detent mechanism 26 of FIG. 1 and depicts a mating of the saw blade depth detent 32 in a groove 56 of the bracket 28. There are a plurality of spaced saw blade depth recesses 56 which are configured for positioning the saw blade 12 at different depth settings marked by indicia 58 to provide a user with a visual indication of the saw blade depth.

The recesses 56 are preferably provided at commonly used saw blade depths that conform to nominal lumber sizes. By way of example, the recesses 56 can be positioned to provide 0, ⅛, ¼, ⅜, ½, ⅝, ¾, 1 and 2 inch saw blade depth settings. The recesses 56 are formed to matingly receive and engage a ridged portion 60 of the saw blade depth detent 32. However, other shapes of the recesses 56 are contemplated. One advantage of forming the recesses 56 in a V-shape is that during saw blade depth adjustment the detent 32 provides self-cleaning action by having the ridged portion 60 fully engage the recesses which facilitates removal of wood sap, sawdust, and other debris from the recesses.

Figure 3:
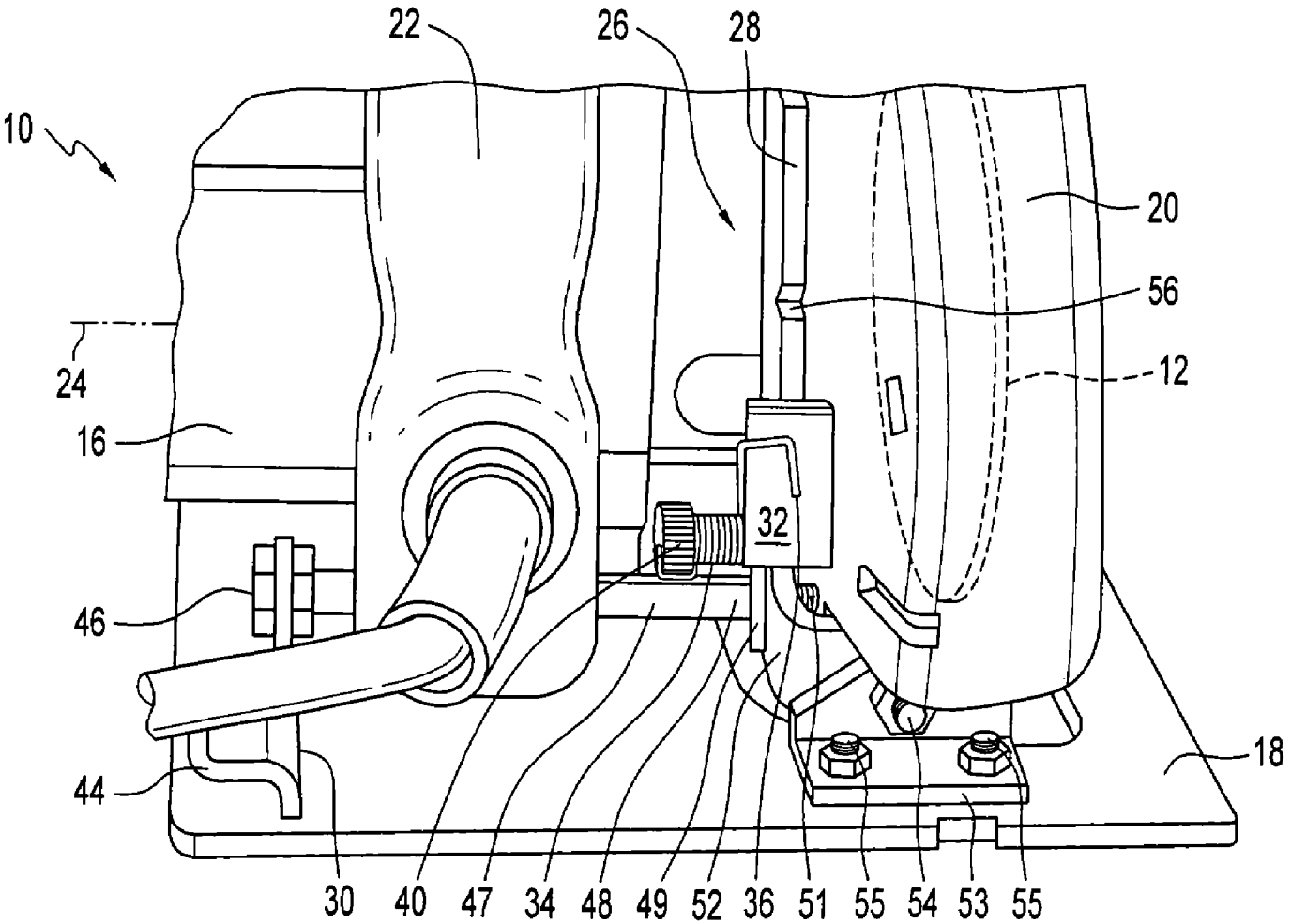
FIG. 3 is another perspective view of the embodiment illustrated in FIG. 1.

After the described position is reached, the bracket 28 and foot 18 can be securely locked into position relative to the housing 16 by the saw blade depth locking lever 30. The lever 30 locks the bracket 28 and foot 18 in a depth of cut position when it is rotated clockwise as shown in FIG. 3. When the lever 30 is rotated counterclockwise, the circular saw 10 can be adjusted to other predetermined depths. For example, when a user disengages the lever 30 from the bracket 28 by rotating the lever counterclockwise the foot 18 is adjustable to select a desired saw blade depth according to one of the predetermined saw blade depth selections. During the pivoting of the foot 18 relative to the housing 16, the detent 32 engages the bracket 28 at each of the recesses 56 enabling a user to rapidly position the saw blade 12 at a desired depth. Moreover, it is envisioned that audio and locking indication provided during the positioning of the detent 32 in the recesses 56 will enable a user to select saw blade depths without referring to the indicia 58 or physically contacting the saw blade 12.

Turning now to the bevel angle adjustment detent mechanism of the circular saw 10 and referring to FIGS. 5–8, the bevel angle adjustment detent mechanism is generally designated as 64. The housing 16 and the saw blade 12 are positioned at a zero bevel angle setting in FIG. 5, and at an inclined angle relative to the foot 18 in FIG. 6. More particularly, the bevel angle adjustment detent mechanism 64 enables an operator of the saw 10 to provide different angles of cut to workpieces.

The bevel angle adjustment detent mechanism 64 pivotally interconnects the foot 18 to said housing 16 such that the housing is adjustable relative to the foot through a range of bevel angles. More particularly, the bevel angle adjustment detent mechanism 64 includes a detent holding assembly 66 carrying a bevel angle detent 68, preferably formed of a plastic material, and a bracket assembly 70 which is attached to the foot 18. The bevel angle adjustment detent mechanism 64 enables the saw blade 12 to be positioned at a number of desired bevel angle settings or a range of bevel angles that are universal to the construction industry.

Figure 5:
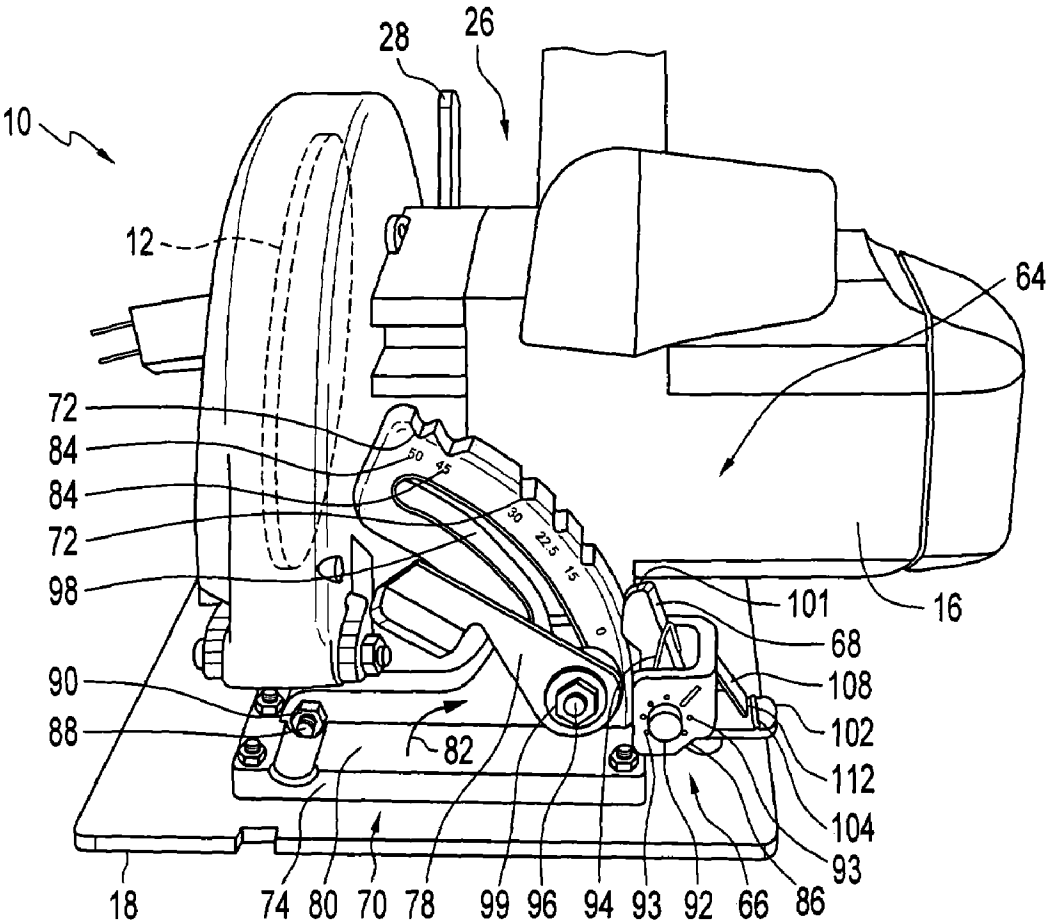
FIG. 5 is a perspective view of the front of the embodiment shown in FIG. 1 and particularly illustrating a bevel angle adjustment detent mechanism set at a zero bevel angle setting and a saw blade depth adjustment detent mechanism.
Figure 6:
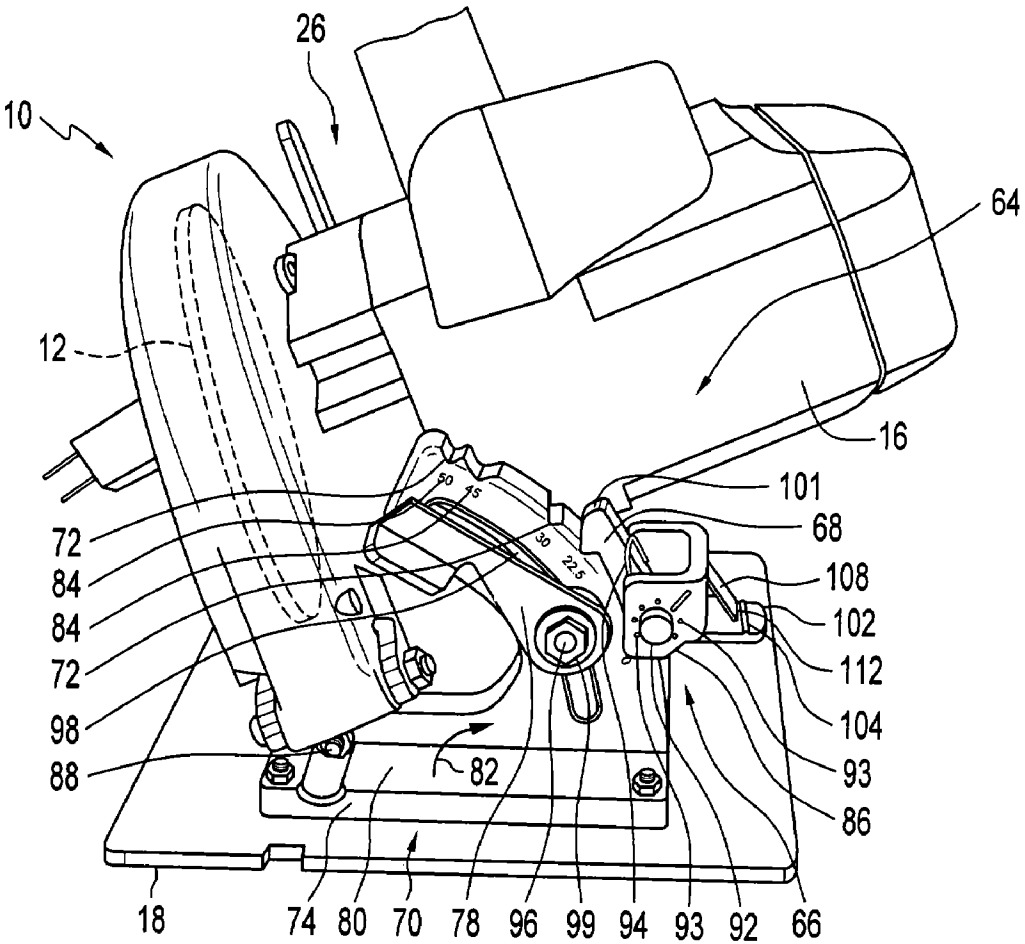
FIG. 6 is a front perspective view of the embodiment illustrated in FIG. 5 rotated to a positive bevel angle.
Figure 7:
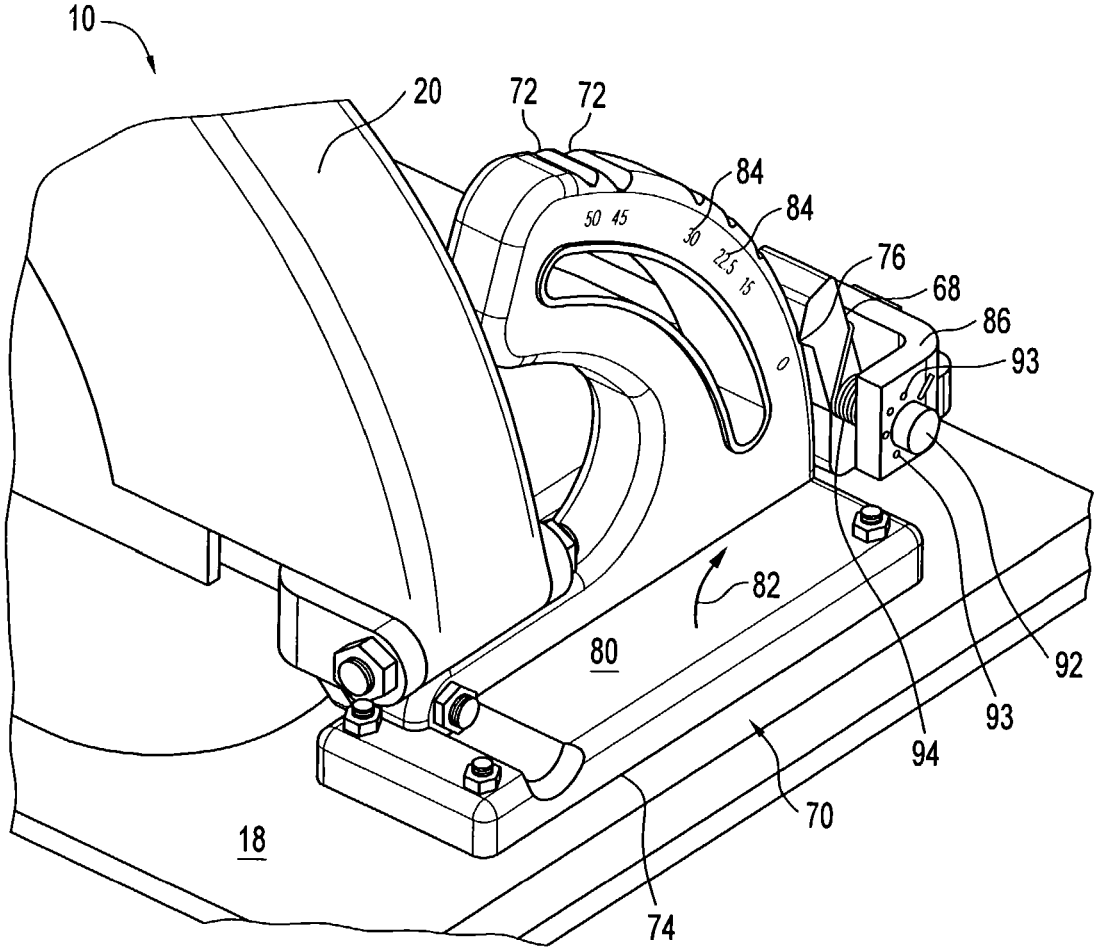
FIG. 7 is a perspective view of the detent holding assembly of the bevel angle adjustment detent mechanism of FIG. 5.
Figure 8:
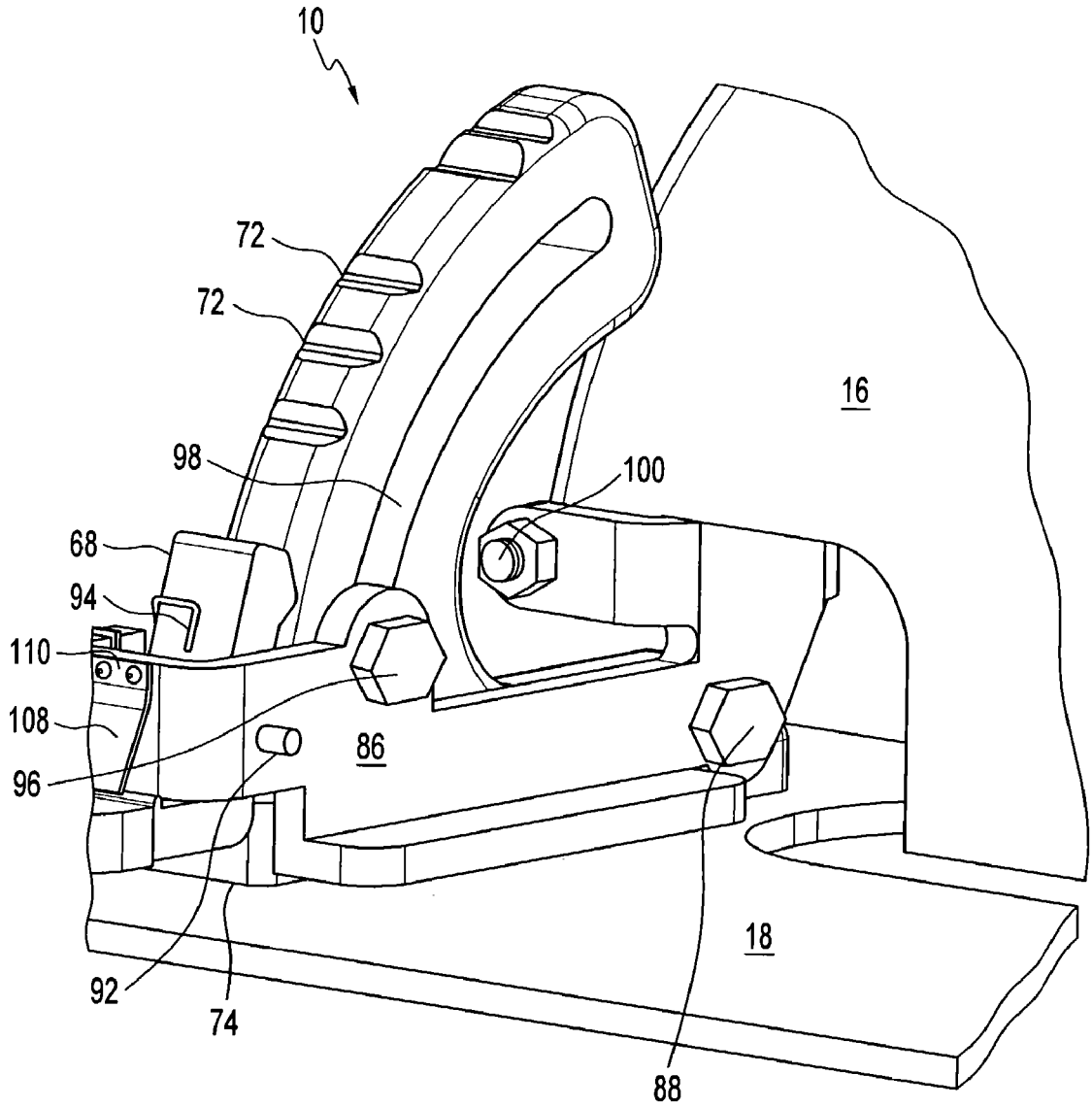
FIG. 8 is a perspective view of the right rear of a portion a mounting bracket and a quadrant bracket of the bevel angle adjustment detent mechanism of FIG. 5.

The bracket assembly 70 includes a plurality of spaced bevel angle recesses 72 positioned on an arcuately-shaped quadrant bracket 74 that is attached, or alternatively integrally molded, to the foot 18. The recesses 72 are each matingly engageable with the bevel angle detent 68 to provide predetermined bevel angle settings within the range of bevel angles. Similar to the recesses 56 of FIG. 4, it is desirable that the recesses 72 be formed in a V-shape to facilitate engagement and disengagement of a ridged portion 76 of the bevel angle detent 68. Moreover, the advantages disclosed for using a plastic material for the saw blade depth detent 32, such as self-cleaning action, are also applicable to the bevel angle detent 68. Another advantage of the present invention is that a user may adjust the saw blade bevel angle rapidly and accurately, and pass several of the recesses 72 before engaging a bevel angle locking lever 78 which locks the saw blade 12 at a desired bevel angle. The lever 78 is configured to rotate between an open position adjacent a base portion 80 of the quadrant bracket 74 and a closed position, wherein the lever 78 is rotated in a clockwise direction of an arrow 82 as illustrated in FIGS. 5–7. The quadrant bracket 74 may also include indicia 84 of the universal bevel angle settings. For example, the indicia 84 can preferably indicate positions of the recesses 72 that correspond to bevel angle settings of 0, 15, 22.5, 30, 45, and 50 degrees.

The detent holding assembly 66 has a mounting bracket 86 in operational relationship with the quadrant bracket 74 and the lever 78. A bolt 88 is threaded through the mounting bracket 86 and engages a nut 90 to fix one end of the quadrant bracket 74 to the mounting bracket. An axial member 92 extends through the mounting bracket 86 and the bevel angle detent 68 to enable pivotable movement of the bevel angle detent about the axial member in the clockwise direction of the arrow 82 and the opposite or counter-clockwise direction. A spring 94 encircles the axial member 92 and biases the bevel angle detent 68 toward the quadrant bracket 74. It is contemplated that the tension in the spring 94 can be manipulated by multiple spring connecting positions 93 on the mounting bracket 86. The mounting bracket 86 connects to the lever 78 via a bolt 96, which is threaded through the mounting bracket. The bolt 96 also passes through a slot 98 in the quadrant bracket 74 and is threadingly engaged to a nut 99 to secure the lever 78 to the quadrant bracket. In addition, the bolt 96 cooperates with the mounting bracket 86 and does not rotate upon movement of the lever 78. As the lever 78 is rotated in the direction of the arrow 82, the quadrant bracket 74 is fixed to the mounting bracket 86. A bolt 100 connects the mounting bracket to the upper guard 20.

During the pivoting of the foot 18 relative to the housing 16, the detent 68 engages the quadrant bracket 74 at each of the recesses 72 enabling a user to rapidly position the saw blade 12 at a desired bevel angle. Moreover, the engagement action caused by the spring 94 during the mating of the bevel angle detent 68 and each of the recesses 72 of the quadrant bracket 74 provides an audio indicator of the saw blade bevel angle. This audio indicator enables a user to adjust the bevel angle of the saw blade 12 to new angles without visually referring to the indicia 84. Moreover, the universal bevel angle settings are accurately achieved without simultaneous locking of the lever 78 while positioning the housing 16 and the saw blade 12 at a fixed bevel angle.

The bevel angle detent 68 is a generally L-shaped member having a first end 101 and a second end 102. The first end 101 includes the ridged portion 76 that is configured for engaging the recesses 72 at the universal bevel angles. The second end 102 is adjacent the foot 18 and includes a radially projecting formation 104. A feature of the second end 102 of the bevel angle detent 68 is that it is configured to allow for manual overriding of the pre-selected bevel angle settings using a bevel angle manual override leaf spring 108. The leaf spring 108 can be engaged by an operator with the radially projecting formation 104, which is fixed on one end 110 to the mounting bracket 86 and has another end 112 for engaging the radially projecting formation. During normal bevel angle adjustment operations wherein the universal bevel angle settings are selectable, the end 112 of the override leaf spring 108 is not engaged with the radially projecting formation 104 which permits the bevel angle detent 68 to engage the recesses 72 of the quadrant bracket 74. However, when the leaf spring 108 is engaged with the radially projecting formation 104, the bevel angle detent is rotated in the clockwise direction of the arrow 82. Under such circumstances, the bevel angle detent 68 does not engage the recesses 72 of the quadrant bracket 74, which allows a continuous range of bevel angles to be selected by simultaneously holding the saw blade 12 at a desired bevel angle while locking the lever 78.

While particular embodiments of the present circular saw have been described herein, it will be appreciated by those skilled in the art that changes and modifications may be made thereto without departing from the invention in its broader aspects and as set forth in the following claims.

What is claimed is:

1. A circular saw comprising:

a housing;

a motor disposed within said housing and configured for rotating a circular saw blade rotatably driven by said motor;

a foot;

a bevel angle adjustment detent mechanism pivotally interconnecting said foot to said housing such that the circular saw blade is adjustable to said foot through a range of bevel angles, said bevel angle adjustment detent mechanism including a detent holding assembly carrying a pivotable bevel angle detent with a pivot axis on one end portion and a transverse ridge spaced from said pivot axis, and an arcuate member defining a plurality of spaced bevel angle recesses, each matingly and releasably engageable with said transverse ridge of said bevel angle detent to provide predetermined bevel angle settings within said range of bevel angles, said detent being disengaged from said bevel angle recess responsive to a releasing force being applied to said foot; and a saw blade depth adjustment detent mechanism pivotally interconnecting said foot to said housing such that the circular saw blade is adjustable to said foot through a range of saw blade depths relative to said foot, said saw blade depth adjustment detent mechanism including a saw blade depth detent having a pivot axis on one end portion and a transverse ridge spaced from said pivot axis, said end with said transverse ridge being biased toward a second member having a plurality of spaced saw blade depth recesses, each recess being matingly and releasably engageable with said transverse ridge of said saw blade depth detent to thereby provide a plurality of predetermined saw blade depth settings within said range of saw blade depths, said detent being disengaged from said saw blade depth recess responsive to a releasing force being applied to said foot.

2. The circular saw of claim 1 further comprising a spring for biasing said bevel angle detent toward said arcuate member.

3. A circular saw comprising:

a housing;

a motor disposed within said housing and configured for rotating a circular saw blade rotatably driven by said motor;

a foot;

a bevel angle adjustment detent mechanism pivotally interconnecting said foot to said housing such that the circular saw blade is adjustable to said foot through a range of bevel angles, said bevel angle adjustment detent mechanism including a detent holding assembly carrying a bevel angle detent and an arcuate member defining a plurality of spaced bevel angle recesses each matingly engageable with said bevel angle detent to provide predetermined bevel angle settings within said range of bevel angles; and a saw blade depth adjustment detent mechanism pivotally interconnecting said foot to said housing such that the circular saw blade is adjustable to said foot through a range of saw blade depths relative to said foot, said saw blade depth adjustment detent mechanism including a saw blade depth detent with a second member having a plurality of spaced saw blade depth recesses, each recess being matingly engageable with said saw blade depth detent to provide predetermined saw blade depth settings within said range of saw blade depths, wherein said bevel angle detent is a generally L-shaped member having a first end configured for engaging said plurality of spaced bevel angle recesses and a notched second end adjacent said foot.

4. The circular saw of claim 3 wherein said detent holding assembly includes a mounting bracket engageable with a locking lever configured for locking said mounting bracket at a bevel angle upon a rotation of said housing relative to said foot.

5. The circular saw of claim 4 wherein said mounting bracket has a manual override leaf spring configured for engaging said notched second end of said bevel angle detent so as to prevent said bevel angle detent from matingly engaging said plurality of spaced bevel angle recesses.

6. The circular saw of claim 5 wherein said notched second end has two notches, and wherein one of said two notches is adjacent said mounting bracket and configured for disengaging said bevel angle detent from said arcuate member.

7. The circular saw of claim 4 wherein said detent holding assembly includes a quadrant bracket in operational relationship with said mounting bracket and said locking lever.

8. The circular saw of claim 7 wherein said quadrant bracket includes said plurality of spaced bevel angle recesses defining said range of bevel angles, and wherein said range of bevel angles includes 0, 15, 22.5, 30, 45, and 50 degrees.

9. The circular saw of claim 4 further comprising an axial member connected to said mounting bracket and having said bevel angle detent rotatably mounted thereto.

10. A circular saw comprising:

a housing;

a motor disposed within said housing and configured for rotating a circular saw blade rotatably driven by said motor;

a foot having a generally flat bottom surface;

a saw blade depth adjustment detent mechanism pivotally interconnecting said foot to said housing such that the circular saw blade is adjustable to said foot through a range of saw blade depths relative to said foot, said saw blade depth adjustment detent mechanism including a first member pivotable about a pivot axis on one end portion and a transverse ridge spaced from said pivot axis, wherein said ridge is biased toward a second member defining a plurality of spaced saw blade depth recesses, each recess being matingly engageable with said transverse ridge of said first member to thereby provide a plurality of predetermined saw blade depth settings within said range of saw blade depths, and said transverse ridge being disengaged from said saw blade depth recess responsive to a releasing force being applied to said foot; and a bevel angle adjustment detent mechanism pivotally interconnecting said foot to said housing such that the circular saw blade is adjustable to said foot through a range of bevel angles, said bevel angle adjustment detent mechanism including a detent holding assembly carrying a pivotable bevel angle detent having a pivot axis on one end portion and a transverse ridge spaced from said pivot axis, said end with said transverse ridge being biased toward an arcuate member defining a plurality of spaced bevel angle recesses, each recess being matingly engageable with said transverse ridge of said bevel angle detent to provide predetermined bevel angle settings within said range of bevel angles, said transverse ridge being disengaged from said bevel angle recess responsive to a releasing force being applied to said foot.

11. A circular saw comprising:

a housing;

a motor disposed within said housing and configured for rotating a circular saw blade rotatably driven by said motor;

a foot having a generally flat bottom surface; and a saw blade adjustment detent mechanism pivotally interconnecting said foot to said housing such that the circular saw blade is adjustable to said foot through a range of saw blade positions relative to said foot, said saw blade adjustment detent mechanism including a detent holding assembly carrying a pivotable saw blade adjustment detent with a pivot axis on one end portion, a transverse ridge spaced from said pivot axis and a spring for biasing said detent into engagement with one of a plurality of spaced recesses, and an arcuate member defining the plurality of spaced position recesses, each matingly and releasably engageable with said transverse ridge of said saw blade adjustment detent to provide predetermined position settings within said range of positions, said detent being disengaged from one of said position recesses when said foot is moved responsive to a user applying a releasing force to said foot without initiating any other action.

12. The circular saw of claim 11 wherein the saw blade adjustment detent mechanism is a bevel angle adjustment detent mechanism pivotally interconnecting said foot to said housing such that the circular saw blade is adjustable to said foot through a range of bevel angles relative to said foot.

13. The circular saw of claim 12 wherein said bevel angle adjustment detent mechanism comprises a bevel angle detent and an arcuate member defining a plurality of spaced bevel angle recesses each matingly engageable with said bevel angle detent to provide predetermined bevel angle settings within said range of bevel angles.

14. The circular saw of claim 12 wherein said detent holding assembly includes a mounting bracket engageable with a locking lever configured for locking said mounting bracket at a bevel angle upon a rotation of said housing relative to foot.

15. The circular saw of claim 11 wherein the saw blade adjustment detent mechanism is a depth adjustment detent mechanism pivotally interconnecting said foot to said housing such that the circular saw blade is adjustable to said foot through a range of saw blade depths relative to said foot.

16. The circular saw of claim 15 wherein said depth adjustment detent mechanism comprises a depth adjustment detent and an arcuate member defining a plurality of spaced depth adjustment recesses each matingly engageable with said depth adjustment detent to provide predetermined depth adjustment settings within said range of depths.

17. The circular saw of claim 15 further comprising a bevel angle adjustment detent mechanism pivotally interconnecting said foot to said housing such that the circular saw blade is adjustable to said foot through a range of bevel angles relative to said foot.

18. The circular saw of claim 17 wherein said bevel angle adjustment detent mechanism includes a bevel angle detent holding assembly carrying a bevel angle detent and an arcuate member defining a plurality of spaced bevel angle recesses each matingly engageable with said bevel angle detent to provide predetermined bevel angle settings within said range of bevel angles.

19. The circular saw of claim 18 wherein said bevel angle detent holding assembly includes a mounting bracket engageable with a locking lever configured for locking said mounting bracket at a bevel angle upon a rotation of said housing relative to foot.

20. A circular saw comprising:

a housing;

a motor disposed within said housing and configured for rotating a circular saw blade rotatably driven by said motor;

a foot having a generate flat bottom surface; and a saw blade adjustment detent mechanism pivotally interconnecting said foot to said housing such that the circular saw blade is adjustable to said foot through a range of saw blade positions relative to said foot, said saw blade adjustment detent mechanism including a detent holding assembly carrying a pivotable saw blade adjustment detent with a pivot axis on one end portion, a transverse ridge spaced from said pivot axis and a spring for biasing said detent into engagement with one of a plurality of spaced position recesses, and an arcuate member defining the plurality of spaced position recesses, each matingly and releasable engageable with said transverse ridge of said saw blade adjustment detent to provide predetermined position settings within said range of positions, said detent being disengaged from one of said position recesses when said foot is moved responsive to a user applying a releasing force to said foot without initiating any other action;

wherein said saw blade adjustment detent mechanism is a bevel angle adjustment detent mechanism pivotally interconnecting said foot to said housing such that the circular saw blade is adjustable to said foot through a range of bevel angles relative to said foot and said detent holding assembly includes a mounting bracket engageable with a locking lever configured for locking said mounting bracket at a bevel angle upon a rotation of said housing relative to foot; and wherein said mounting bracket has a manual override leaf spring configured for engaging a radially projecting formation of said bevel angle detent so as to prevent said bevel angle detent from matingly engaging said plurality of spaced bevel angle recesses.

21. A circular saw comprising:

a housing;

a motor disposed within said housing and configured for rotating a circular saw blade rotatably driven by said motor;

a foot movably attached to said housing and having a generally flat bottom surface; and an adjustment detent mechanism pivotally interconnecting said foot to said housing such that the circular saw blade is adjustable relative to said foot through a range of positions, said adjustment detent mechanism including a detent holding assembly carrying a pivotable adjustment detent with a pivot axis on one end portion and a transverse ridge spaced from said pivot axis and a spring for biasing said detent into engagement with one of a plurality of spaced position recesses, and an arcuate member secured to said foot and defining the plurality of spaced position recesses, each matingly and releasably engageable with said transverse ridge of said adjustment detent to provide predetermined position settings within said range of positions, said detent being disengaged from one of said position recesses as a direct result of a user applying a releasing force to said foot which moves said foot without any other action.

* * * * *